US005564161A

United States Patent [19]

Glatz

[11] Patent Number: 5,564,161

[45] Date of Patent: Oct. 15, 1996

[54] VACUUM CLEANER NOZZLE

[75] Inventor: Dietmar Glatz, Olpe, Germany

[73] Assignee: Wessel-Werk GmbH & Co. KG, Reichshof, Germany

[21] Appl. No.: 190,340

[22] Filed: Feb. 1, 1994

[30] Foreign Application Priority Data

Feb. 16, 1993 [DE] Germany ..... 43 04 681.9

[51] Int. Cl.[6] ..... A47L 9/02

[52] U.S. Cl. ..... 15/415.1; 15/401

[58] Field of Search ..... 15/393, 396, 397, 15/398, 401, 415.1

[56] References Cited

U.S. PATENT DOCUMENTS

| | | | |
|---|---|---|---|
| 1,033,016 | 7/1912 | Hope | 15/393 |
| 1,208,165 | 12/1916 | Kent | 15/415.1 |
| 1,856,031 | 4/1932 | Riebel | 15/393 |
| 2,216,275 | 10/1940 | Kroenlein | 15/393 |
| 2,555,979 | 6/1951 | Lofgren . | |

FOREIGN PATENT DOCUMENTS

| | | | |
|---|---|---|---|
| 706716 | 3/1932 | France | 15/393 |
| 1775716 | 10/1958 | Germany . | |
| 1860267 | 10/1962 | Germany . | |
| 2005499 | 8/1971 | Germany | 15/398 |
| 315101 | 7/1956 | Switzerland | 15/393 |
| 461452 | 10/1936 | United Kingdom . | |

*Primary Examiner*—David Scherbel
*Assistant Examiner*—Terrence R. Till
*Attorney, Agent, or Firm*—Meltzer, Lippe, Goldstein, et al.

[57] ABSTRACT

The vacuum cleaner nozzle of the present invention has a nozzle body with a suction pipe connecting piece and a bottom plate which closes off the nozzle body towards the bottom, whereby the bottom plate is provided with at least one flow channel open towards the bottom to allow air to flow into a suction channel centrally connected to the suction pipe connecting piece, said nozzle body being provided with sealing or closing elements which surrounds the flow channel at least in part. The nozzle body and the bottom plate are made in the form of a one-piece supporting base into which the flow channel or the flow channels and the suction channel are directly molded. The sealing or closing elements in the form of bristle strips and/or sealing lips are molded directly into the bottom plate and/or are pressed, injected or glued into it. This design reduces the number of components of the vacuum cleaner nozzle considerably so that a significant simplification is achieved with respect to manufacture and assembly.

9 Claims, 2 Drawing Sheets

VACUUM CLEANER NOZZLE

BACKGROUND OF THE INVENTION

The invention relates to a vacuum cleaner nozzle. More particularly, the present invention relates to nozzles with reduced number of parts.

Vacuum cleaner nozzles of the type discussed here are normally made in several parts. The nozzle body itself is usually a plastic housing and, serves as a holding device for all of the operating units of the nozzle. The nozzle housing is closed towards the bottom, i.e. in the direction of the floor to be vacuumed, by a gliding sole made of steel sheet in which flow channels for the obtention of optimal suction effect and optimal dirt particle conveyance are incorporated. The flow channels are surrounded by suction sealing edges protruding in the manner of beads to achieve optimal dust collection. Furthermore a bristle holding plate which can be switched to different positions for different floor coverings by means of a pedal situated and mounted in the housing is normally provided near the gliding sole.

These known nozzles have absolutely satisfactory properties with respect to their functioning capability. It is however a disadvantage of these known nozzles that they consist of a relatively great number of components and operating units that incur relatively high manufacturing and assembly cost. This is especially significant because a vacuum cleaner nozzle of this type is a product of industrial mass production where unit costs are of critical importance.

It is the object of the instant invention to create, on basis of this state of the art, a vacuum cleaner nozzle for which the manufacturing and assembly costs are reduced while characteristics in operation remain substantially the same.

SUMMARY OF THE INVENTION

According to the present invention the vacuum cleaner nozzle comprises a nozzle body and a bottom plate which closes the nozzle body towards the bottom. The bottom plate serves at the same time as a gliding plate, where the term "gliding plate" in the sense of the instant invention also includes a configuration in which the plate is provided with rolling elements, in particular rollers or wheels for better steering. Contrary to the known vacuum cleaner nozzles where the nozzle body and the gliding plate are separate components, the nozzle body and the bottom plate are made as a one-piece supporting base according to the invention. A supporting base of this type is preferably made of plastic and is produced in particular by injection molding or compression molding.

The central suction channel and at least one flow channel for the distribution of the suction capacity and for better removal of the dirt particles are molded directly into the bottom plate and thereby into the one-piece supporting base during the manufacture of the supporting base. The flow channel is here open towards the bottom, i.e. towards the floor to be vacuumed. The flow channel lets out into the suction channel which is in turn connected to a terminal suction pipe connection piece in a manner allowing air flow to go through.

Furthermore sealing or closing elements serve to maintain a more or less precisely defined distance between the bottom plate and the floor to be vacuumed. The sealing or closing elements are molded and/or pressed, injected or glued into the bottom plate of the supporting base according to the present invention. Preferably, these sealing elements can be placed into the injection molding form during the manufacture of the supporting base before the form is filled, and the injection molding material can be injected all around them as the form is being filled.

The number of separate components is significantly reduced through the one-piece design of the nozzle support and the bottom plate, with the essential operating elements such as flow channel, suction channel and the sealing or closing elements surrounding the flow channel being an integral part of the supporting base. In this the manufacturing costs and in particular assembly costs are advantageously reduced.

In order to distribute the suction capacity of the vacuum cleaner nozzle over the entire width of the nozzle, the flow channels that flow to into the suction channel are essentially parallel with the forward or rear edge of the supporting base or the bottom plate in one embodiment of the present invention, and are open to the outside in an axial direction, referring to the longitudinal axis of the flow channels. In order to distribute the suction capacity over the length of the channels in as uniform a manner as possible, the flow channels are made doubly parabolic, i.e. their cross-section as well as their longitudinal section with reference to the longitudinal axis of the flow channels are parabolic, whereby a parabola profile with two parabola branches. The first parabola branch is open towards the bottom as seen in the cross-section of the flow channel perpendicular to the forward or rear edge of the supporting base. The second parabola branch is open towards the suction channel in a section profile that narrows parabolically away from the suction channel to form in the longitudinal section.

In principle the vacuum cleaner nozzle of the present invention can be designed in a known manner, strictly as a gliding nozzle, i.e. without roller elements. However, in particular if the supporting base and thereby the bottom plate is made of plastic which has the disadvantage to be more subject to wear than a metal finish, the vacuum cleaner nozzle is provided near the bottom plate with at least two forward rollers which are placed in the flow channel near the axial outer ends in such manner that they substantially close off the flow channels to the outside. Preferably each roller is mounted in the flow channel via two elastically deformable axle arms, with each of these axle arms being either molded into the bottom of the flow channel so as to form one piece with same or being attached at that point, in particular in the manner of a snap-in connection. Due to the elastic deformability of the axle arms the latter escape laterally, for instance if the user of the vacuum cleaner nozzle inadvertently steps on the supporting base. The danger of breakage and therefore of damage to the roller mounts is thereby significantly reduced. In this design the diameters of the rollers are preferably at least slightly greater than the depth of the flow channels in this area. This results in positive locking and frictional connection directly between the bottom of the flow channels and thereby of the supporting base, the rollers and the floor. Following an elastic deformation or an elastic lateral deformation of the axle arms in the case of inadvertent load, the bottom plate of the present invention and thereby the especially delicate edges of the flow channels remain at a sufficiently safe distance from the floor so that damage to the edges is reliably prevented.

The forward or rear edges of the flow channels, as seen in a direction transverse to their longitudinal axis, are preferably made of suction or flow sealing edges that cover at least part of their length, in order to increase the suction capacity of the nozzle. These suction or flow sealing edges may be formed by having the edges themselves protrude in the form of beads from the plane of the bottom plate. Preferably however, the flow sealing edges are formed in the flat area in front of the forward flow channel edge and/or the flat area behind the rear flow channel edge so that they are at least at a slight angle from the horizontal or the plane of the bottom plate, with the angle of inclination being selected so that the flow channel edge is given at least a slightly wedge-shaped profile. To improve the cleaning characteristics of the vacuum cleaner nozzle according to the present invention, thread lifters in the form of strips or bands are provided on the bottom plate in a known manner directly before and/or behind the suction channel. These thread lifters are either molded or injection-molded directly into the supporting base during its manufacture or are glued, pressed or welded into suitable recesses provided in the supporting base.

The vacuum cleaner nozzle according to the present invention is provided with a suction pipe connecting piece for the connection of the suction pipe of a vacuum cleaner. This suction pipe connecting piece can also be molded to the supporting base near the suction channel so as to form one piece with it, a further reducing the number of parts. Preferably however, the suction pipe connecting piece is made in the form of an articulated connection which can be attached by its first end to the outlet of the suction channel and by its second end to the suction pipe of a vacuum cleaner, in particular in the manner of a snap-in connection in such manner as to be removable.

The sealing or closing elements which surround the flow channels at least in part at a distance consist preferably and in function of the desired application of a wreath of bristles and/or of sealing lips. The sealing lips are made of an elastomer material. Sealing lips are used where the planned application of the nozzle is for smooth floors or for wet vacuuming.

In order to further improve the ease of operation of the vacuum cleaner nozzle, at least one rear roller can be provided on the supporting base in the area of the suction pipe end on the side of the suction channel. In that case this rear roller may be used as the sole roller or in combination with the earlier-described forward rollers. The present invention is described in greater detail through an example of the preferred embodiment shown in drawings.

DETAILED DESCRIPTION OF THE PREFERRED EMBODIMENT

Figure 1:
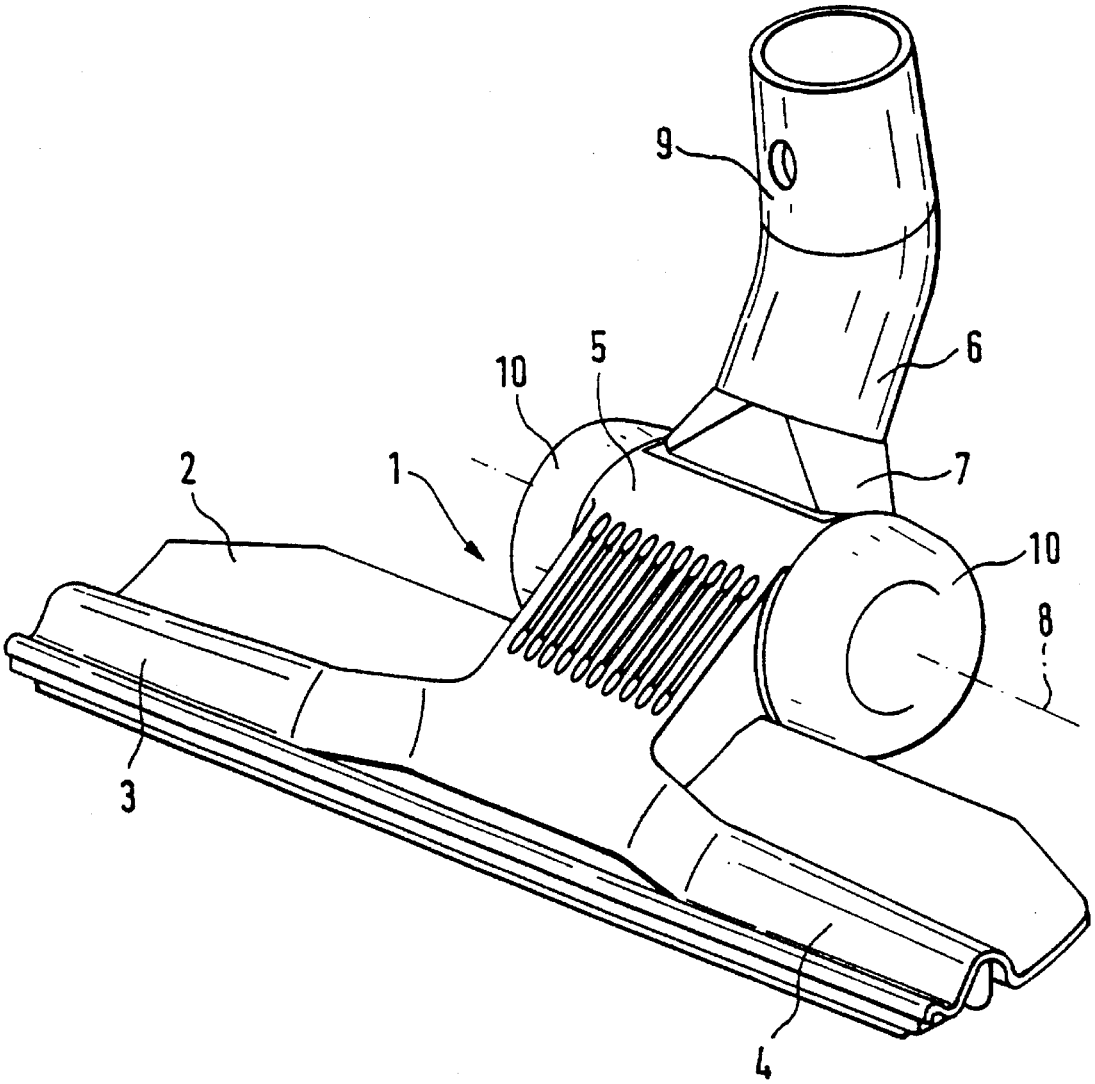
FIG. 1 shows an embodiment of a vacuum cleaner nozzle according to the present invention, in a perspective view.

FIG. 1 shows a perspective view of an preferred embodiment of a vacuum cleaner nozzle according to the present invention. The vacuum cleaner nozzle has a nozzle body 1 to which a bottom plate 2 is molded in one piece so that a one-piece supporting base is formed. Molded into the supporting base are flow channels 3 and 4 as well as a suction channel 5. The suction channel is substantially centered with respect to the width of the nozzle and lets air in the flow channels 3 and 4 flow into a suction pipe connecting piece 6 which is made in the form of an articulated connection.

Figure 3:
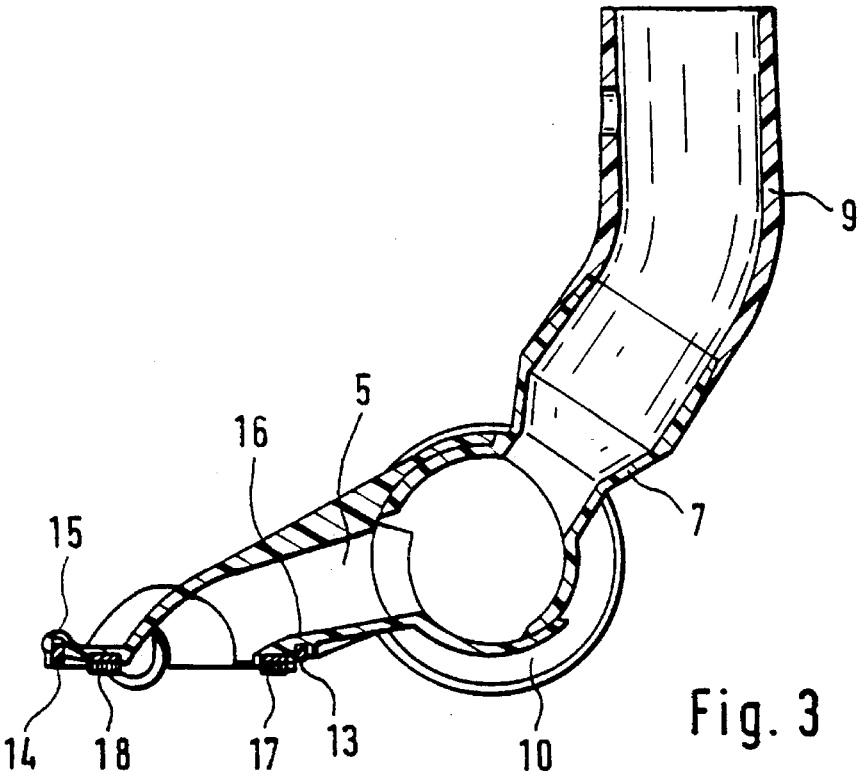
FIG. 3 shows the embodiment of FIG. 1 in a cross-section along intersection line A—A according to FIG. 2.

As can be seen in particular in the drawing of FIG. 3, the suction pipe connecting piece consists of an articulated element 7 on the nozzle side which articulately snaps into an appropriately formed opening of the supporting base leading to the suction channel 5 in such manner that the articulated element 7 can be swivelled around axis 8 and is articulately connected to an articulated element 9 on the suction pipe side which is rotatably connected to the articulated element 7.

Figure 2:
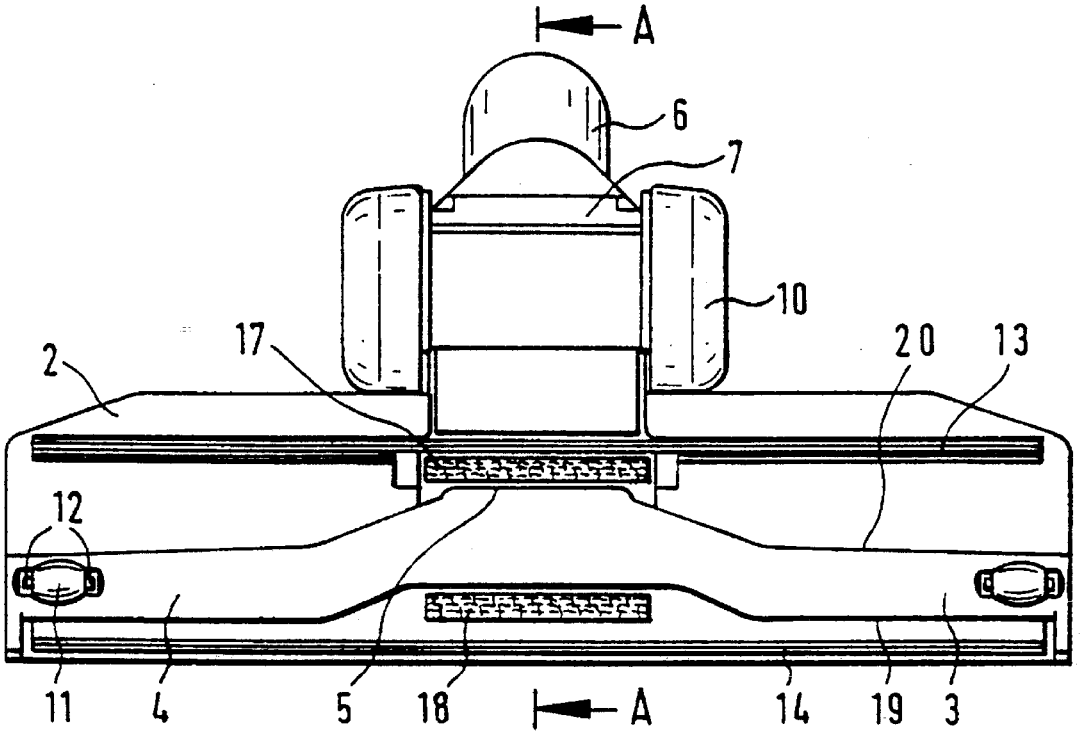
FIG. 2 shows the embodiment of FIG. 1 as seen from below.

Near the end of suction channel 5 on the suction pipe side two rear rollers 10 are installed on a common axis in order to improve the ease of operation of the vacuum cleaner nozzle. FIG. 2 shows the vacuum cleaner nozzle according to FIG. 1 as seen from below. It can be seen from this drawing that the flow channels 3 and 4 are essentially parallel to the front or rear edge of the bottom plate, i.e. they extend at a perpendicular to the intersection line A—A. The flow channels 3 and 4 are designed so as to be open in axial direction to the outside, with one forward roller 11 being installed in each outermost axial area. Both flow channels let air flow into the suction channel 5 in the inner axial area. Each roller 11 is mounted on two axle arms 12 which lock into corresponding recesses in the bottoms of the flow channels 3 and 4. The axle arms 12 are made of an elastically yielding material. The diameter, i.e. more precisely the maximum central diameter of the rollers 11 is here at least slightly greater than the depth of the flow channels 3 and 4 in this area. In other words, this means that if the operator of the vacuum cleaner nozzle inadvertently-steps on the supporting base from above, the axle arms 12 deflect to the side until the rollers 12 come to lie at the bottom of the flow channels 3 and 4. This produces a positive locking and frictional connection directly between the bottom of the flow channels, the roller and the floor, whereby a safety distance remains under all circumstances between the bottom surface of the gliding sole or underside of the bottom plate 2 and the floor. Damage to the edges of the flow channels 3 and 4 is thereby reliably avoided.

As can also be seen in the drawing of FIG. 2, sealing or closing elements in the form of elastomer sealing lips 13 and 14 are provided in the bottom plate 2. The sealing lips 13, 14 extend essentially over the entire width of the vacuum cleaner nozzle and enclose within themselves the flow channels 3 and 4. As can be seen from the drawing in FIG. 3, the sealing lips are separately prefabricated sealing strips inserted into corresponding groove-like recesses 15 and 16 in the bottom plate 2 and are glued in place or attached by ultrasound welding.

To improve the cleaning action of the vacuum cleaner nozzle, thread lifting strips 17 and 18 are installed near the bottom of the bottom plate 2 respectively in front of and behind the opening of the suction channel 5. These thread lifting strips 17 and 18 are made in a known manner of a pile-like textile material, the pile of which points in the direction of the respective opening of the suction channel 5. The thread lifters are glued into recesses in the bottom plate 2.

I claim:

1. Vacuum cleaner nozzle having a nozzle body, said nozzle body provided with a bottom, a suction channel, said suction channel having an outlet, said suction channel further having an end, a suction pipe connecting piece, and a bottom plate closing said nozzle body towards said bottom, whereby said nozzle body and said bottom plate are made into a one-piece supporting base, said bottom plate is further provided with at least one flow channel, said flow channel having a longitudinal axis, a bottom, a depth, a forward edge, a rear edge, and an outer end, said flow channel further open towards said bottom of said nozzle body, said flow channel further constructed and arranged to allow air to flow into a central suction channel connected to said suction pipe connecting piece, said flow channel surrounded at least in part by sealing elements, wherein said flow channel and the suction channel are molded directly into said one-piece supporting base with said nozzle body, wherein the flow channel is double-parabolic.

2. Vacuum cleaner nozzle as in claim 1, wherein said flow channel is essentially parallel to the front and rear edges of said supporting base.

3. Vacuum cleaner nozzle as in claim 1, comprising at least one forward roller, said roller being installed in said flow channel near said outer end, said roller constructed and arranged to substantially close off said flow channel from the outside.

4. Vacuum cleaner nozzle as in claim 1, wherein said suction channel has a strip of thread lifters which is located directly in front of said suction channel, said strip of thread lifters being directly molded during the manufacture of said supporting base.

5. Vacuum cleaner nozzle as in claim 1, wherein said forward edge and said rear edge of said flow channel are made at least in part as flow sealing edges which are perpendicular to said longitudinal axis of said flow channel.

6. Vacuum cleaner nozzle as in claim 5, wherein said flow sealing edges are formed on said bottom plate with a first sealing edge formed in front of said forward edge of said flow channel and a second sealing edge formed on said bottom plate behind said rear edge of said flow channel, said sealing edges further being inclined at least slightly with respect to the horizontal.

7. Vacuum cleaner nozzle as in claim 1, wherein said suction pipe connecting piece is an articulated connection which can be snapped in with a first end at said outlet of said suction channel, said suction pipe connecting piece further constructed and arranged to allow a second end to be removably connected to the suction pipe of a vacuum cleaner.

8. Vacuum cleaner nozzle as in claim 1, wherein at least one rear roller is installed near said end of said suction channel on the same side as said suction pipe connecting piece.

9. Vacuum cleaner nozzle as in claim 1, wherein said sealing elements comprise sealing lips, said sealing lips being made of an elastomer material.

* * * * *